US006925955B1

(12) United States Patent
Brooks

(10) Patent No.: US 6,925,955 B1
(45) Date of Patent: Aug. 9, 2005

(54) SEATING AND ROWING ATTACHMENT FOR INFLATABLE RAFT

(76) Inventor: Kevin Brooks, 830 Bywater Way North, Port Ludlow, WA (US) 98365

( * ) Notice: Subject to any disclaimer, the term of this patent is extended or adjusted under 35 U.S.C. 154(b) by 0 days.

(21) Appl. No.: 10/680,912

(22) Filed: Oct. 7, 2003

Related U.S. Application Data

(60) Provisional application No. 60/418,145, filed on Oct. 11, 2002.

(51) Int. Cl.[7] ..... B63B 7/00
(52) U.S. Cl. ..... 114/345; 114/363; 440/104
(58) Field of Search ..... 114/343, 345, 364, 114/363; 440/101, 104, 105, 106

(56) References Cited

U.S. PATENT DOCUMENTS

| | | | | |
|---|---|---|---|---|
| 2,815,517 | A | 12/1957 | Andresen | |
| 3,694,835 | A | 10/1972 | Casey | |
| 3,718,365 | A | 2/1973 | Gibson | |
| 4,068,611 | A | 1/1978 | Leather | |
| 4,290,156 | A | 9/1981 | Rawson | |
| 4,672,911 | A | 6/1987 | Hodgins | |
| 4,909,177 | A | 3/1990 | Jones | |
| 4,966,091 | A | 10/1990 | D'Aulan | |
| 5,101,753 | A | 4/1992 | Hull | |
| 5,154,134 | A | 10/1992 | Goldsmith | |
| 5,325,806 | A | 7/1994 | Lee | |
| 5,474,481 | A | 12/1995 | Ramsey | |
| 5,816,873 | A | 10/1998 | Pestel | |
| 5,848,924 | A * | 12/1998 | Langreck | 440/106 |
| 5,878,688 | A | 3/1999 | Merrett | |
| 6,038,991 | A | 3/2000 | Nelson | |
| 6,164,237 | A | 12/2000 | Coryell | |
| 2002/0129756 | A1 * | 9/2002 | Myers | 114/354 |
| 2003/0024462 | A1 | 2/2003 | Frederick | |

OTHER PUBLICATIONS

Bucks Bags Inc., Catalog, circa 1999, cover page and pp6 & 7.

* cited by examiner

*Primary Examiner*—Stephen Avila
(74) *Attorney, Agent, or Firm*—Laurence C. Bonar

(57) ABSTRACT

This invention provides an attachment for inflatable watercraft such as inflatable rafts to render such watercraft more suitable for sports fishing. The attachment includes a swivelable seat mounted at a convenient height for fishing, oarlocks mounted at the optimum position for rowing while seated, and, in the preferred embodiment, means for deploying an anchor or drag to keep the watercraft in the desired location. The attachment is mounted on and supported by the gunwales of the inflatable watercraft, to distribute the weight of the attachment and its user over as wide an area as possible in order to enhance the stability of the watercraft in use.

21 Claims, 7 Drawing Sheets

SEATING AND ROWING ATTACHMENT FOR INFLATABLE RAFT

This application claims benefit of Provisional Application 60/418,145 Filed Oct. 11, 2002.

FIELD OF THE INVENTION

This invention relates to an attachment to an inflatable raft to make it more suitable for such recreational activities as sport fishing.

BACKGROUND

Watercraft used for sport fishing take many forms, depending on the type of sport fishing done, the nature of the water where the fishing is done, and the personal preferences of the angler.

Skiffs, canoes, rowboats and kayaks have been widely used for years for sport fishing. In recent years, fishing watercraft employing inflatable tubes, floats, pontoons or sponsons, and designed for use by a single angler, or occasionally by two anglers, have become popular for sport fishing. Such craft as the float tubes and pontoon boats made by Bucks Bags, Inc. of Boise, Id., are well-known and widely used for sport fishing. While these watercraft perform admirably, they are single-purpose craft, and are not generally useful for other water-based recreational activities.

There are other types of small watercraft designed for general recreational use, which can also be used for sport fishing. Of particular interest in this regard are small inflatable rafts such as the Caravelle and Fish Hunter rafts distributed by Sevylor U.S.A., Inc. of Los Angeles, Calif. and the Sea Eagle rafts, produced by Sea Eagle Products of Port Jefferson, N.Y. The rafts are relatively inexpensive, and can be used for such recreational applications as yacht tenders, transportation to camping facilities accessible only by water, and increasing the safety and enjoyment of swimming and bathing. While they can be used in their as-purchased form for fishing, they are much less comfortable and convenient than watercraft designed specifically for that sport. In particular, for such very popular types of fishing as fly casting or bait or plug casting in rivers, lakes and ponds, the seats are too low or non-existent, and the craft are awkward to row from a position used for fishing. Ideally, a watercraft for sport fishing should provide a swivelable seat positioned slightly above the sides of the craft, high enough above the floor of the watercraft to permit a comfortable seated position for the user, with oarlocks conveniently positioned for rowing. Provisions for deploying an anchor, or a drag would also be desirable. (A drag, generally consisting of a bundle of short segments of chain attached to a line, are used to slow down the drift of a boat, and keep the bow of a boat headed upstream or upwind as it drifts under the influence of current or wind.) The seat and oarlock positioning in such pontoon boats for fishing as the "Southfork", manufactured by Bucks Bags, Inc. of Boise, Id., or the "PAC 800, manufactured by Outcast Sporting Gear, also of Boise, Id., are ideal for fishing.

An inexpensive attachment which can render such general-purpose recreational watercraft as inflatable rafts more suitable for sport fishing would be a very useful addition to the sporting equipment arena.

Hull et al. (U.S. Pat. No. 5,101,753) describe a seat attachment advantageous for fishing for use on an inflatable raft equipped with a mounting board for an outboard motor. The seat is attached to and supported in part by the mounting board. The attachment of Hull et al. is suitable only for inflatable rafts equipped with a motor mounting board. In addition, it requires the use of a rigid floor in the raft, since the seat attachment is supported, in part, by legs resting on the floor.

Lee (U.S. Pat. Nos. 5,507,244 & 5,325,806) describes a seat and accessory mounting attachment for inflatable rafts, canoes and kayaks comprising a relatively rigid frame resting on the floor of the inflatable craft to distribute the weight of the seat and occupant over the floor. The attachment of Lee does not distribute the weight of attachment and occupant over the full width of the inflatable craft, with resultant decreased lateral stability against tipping or rolling, particularly if it is desired that the seat be elevated above the gunwales or inflated sides of the craft. The attachment of Lee does not provide a swivelable seat or oarlock mounting means.

Rawson (U.S. Pat. No. 4,290,156) teaches a seat and oarlock attachment for an inflatable raft supported from the gunwales, with transverse cross-members supporting a seat. In the attachment of Rawson, the seat is suspended below the cross-members. It does not provide for a swivelable seat, nor can the seat be mounted above the gunwales, as is desirable.

Casey et al. (U.S. Pat. No. 3,694,835) teach a rigid frame which can support a swivelable seat, the frame being enclosed within an inflatable O-shaped tube similar to a tire inner-tube. The device taught by Casey et al. requires the inflatable tube to have an open bottom, which would have little use as a general purpose watercraft upon removal of the frame.

Andresen (U.S. Pat. No. 2,815,517) teaches an attachment comprising a seat equipped with extension arms upon which oarlocks are mounted. The attachment of Andresen is clamped to the gunwales of a watercraft such as a canoe, and is not adaptable for use with an inflatable raft.

While all of the above devices appear workable, these devices, and all other similar attachments known to the inventor of the present invention, suffer from drawbacks, and have not found widespread acceptance. Thus there is a need for a low-cost, simple, durable attachment for inflatable rafts to make such rafts more suitable for sport fishing. The attachment should be easy to attach to and detach from the raft, so the raft can be easily used for other recreation purposes for which it is suited.

SUMMARY OF THE INVENTION

It is an objective of the present invention to provide a low-cost seating and rowing attachment for an inflatable raft to render the raft more suitable for such recreational activities as sport fishing.

It is another objective of the present invention to provide such an attachment which can be quickly and easily mounted on an inflatable raft, and as quickly and easily dismounted from the inflatable raft, restoring the raft to its original configuration and utility.

It is a further objective of the present invention to provide such an attachment which can be mounted on an inflatable raft without the need for tools.

It is a further objective of the present invention to provide such an attachment that fastens sufficiently securely to the inflatable raft that the attachment will remain attached to the raft in the event the raft is inadvertently capsized.

It is a further objective of the present invention to provide such an attachment comprising a plurality of parts such that, when the attachment is dismounted from the inflatable raft, the constituent parts can readily be stowed in a confined space such as the trunk of an automobile.

It is a further objective of the present invention to provide such an attachment with a seat positioned at a desirable and comfortable position for sport fishing.

It is a further objective of the present invention to provide such an attachment comprising oarlocks at an desirable location for convenient rowing while sport fishing.

It is a further objective of the present invention to provide such an attachment comprising means to deploy an anchor or drag to stabilize the position and alignment of the raft with the attachment against wind or current.

To accomplish these objectives, the attachment of the present invention provides support members mounted on each of the side inflated members of the inflatable raft and alternatively also on the forward inflated member of the raft, and a lightweight frame detachably attached to the support members upon which a seat suitable for fishing, oarlocks suitably positioned for convenient rowing, and alternatively, a support member for deployment of an anchor or drag, are attached.

DETAILED DESCRIPTION OF THE INVENTION

Figure 1:
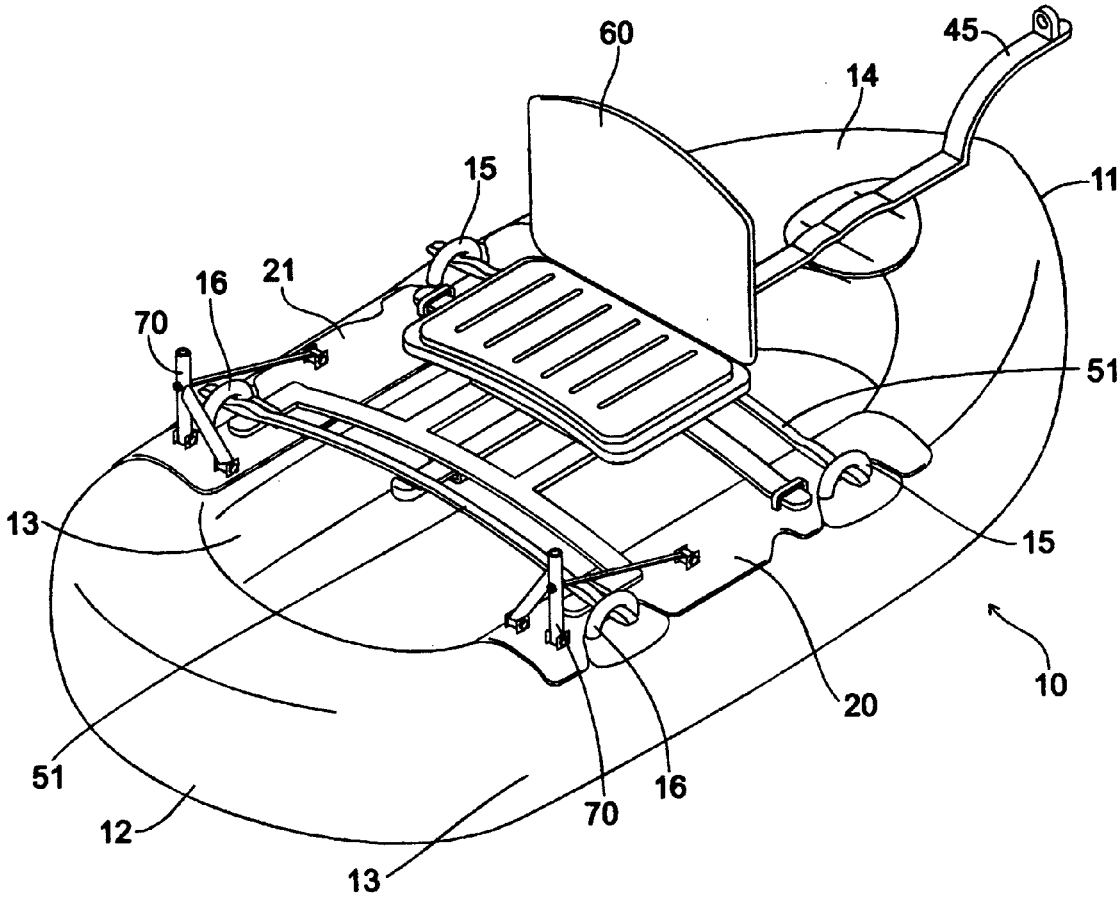
FIG. 1 is a perspective sketch of a preferred embodiment of the seating and rowing attachment of the present invention mounted on a typical inflatable raft.

The seating and rowing attachment (hereinafter "the attachment") of the present invention comprises gunwale mounting means which fit on the inflated tube structures comprising the gunwales of an inflatable raft and which interact with attachment means of an inflatable raft; seat support means detachably attached to the gunwale mounting means, to which a suitable seat for fishing can be detachably attached; locking means to hold seat support means in place; and oarlock support means removably or foldably attached to the gunwale mounting means.

The attachment of the present invention may be fabricated of any sufficiently strong and formable material, such as, for example steel, stainless steel, aluminum or wood. In the preferred embodiment, the attachment is fabricated of molded resin-filled fiberglass, except for the oarlock support means, which are of steel. Fabrication techniques for resin-filled fiberglass structures such as the attachment of the present invention are well known in the art.

The attachment of the present invention is intended for use with an inflatable raft 10 with forward 11 and rearward 12 ends. The raft will comprise attachment means 15 and 16 which may be used to secure the attachment to the raft. In the most preferred embodiment of the present invention, inflatable raft 10 is the Model K-85 distributed by Sevylor U.S.A., Inc. of Los Angeles, Calif. Attachment means 15 and 16 of this raft are half-rings, intended for use as simple oarlocks, attached to a base which is firmly bonded to the material of the lateral gunwales 13 of the raft.

Figure 2:
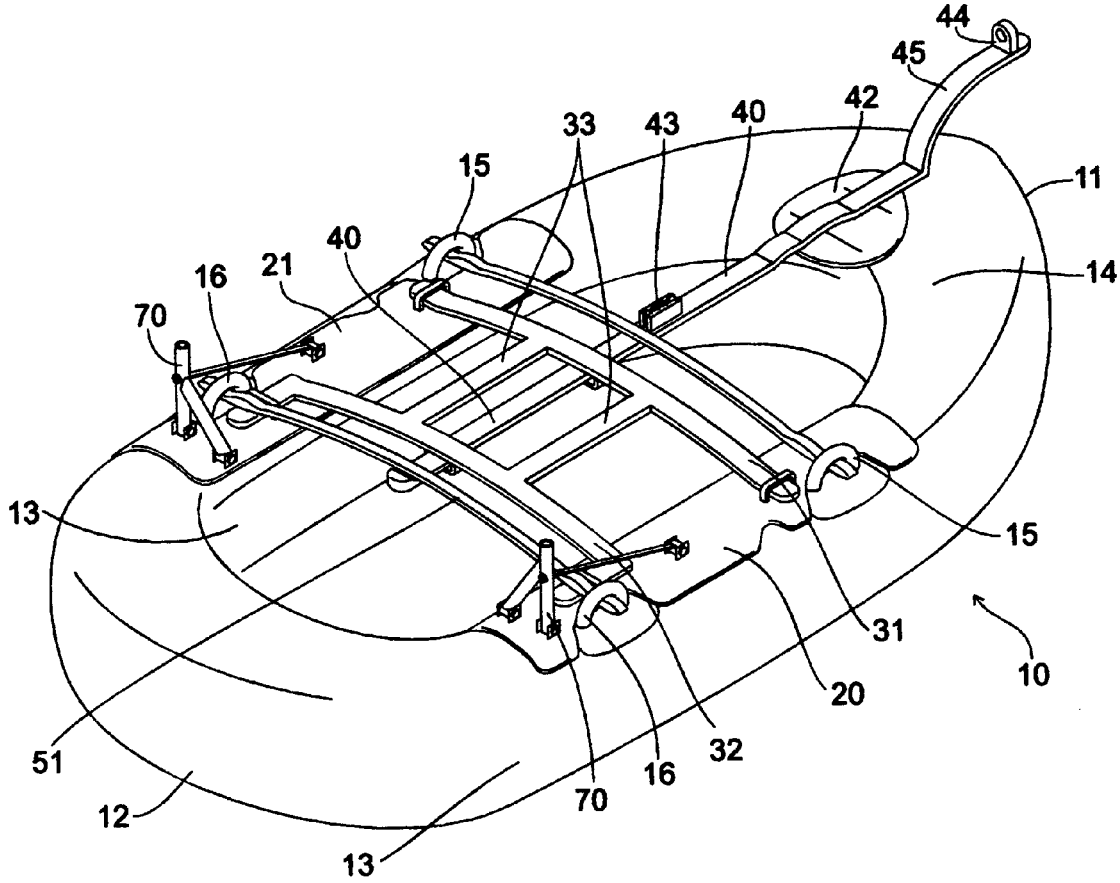
FIG. 2 is a similar perspective sketch of a preferred embodiment of the seating and rowing attachment of the present invention mounted on a typical inflatable raft, with the seat removed to more clearly illustrate the invention.
Figure 3:
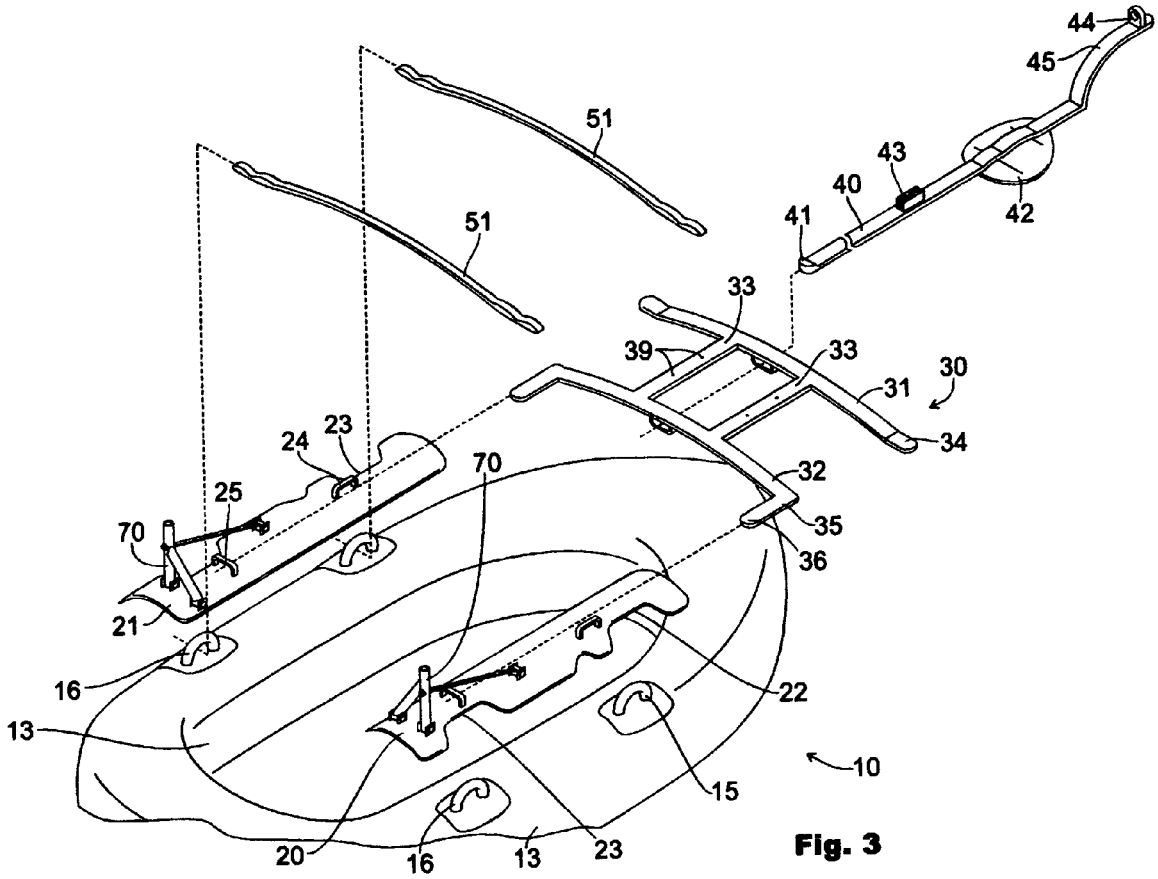
FIG. 3 is an exploded drawing of a preferred embodiment of the seating and rowing attachment of the present invention mounted on a typical inflatable raft.

With reference to FIGS. 1–3, in a preferred embodiment of the present invention, lateral gunwale mounting means comprise lateral gunwale mounting plates 20 and 21 mounted on lateral gunwales 13 of inflatable raft 10. Lateral gunwale mounting plates 20 and 21 are curved about an axis parallel their long axis so as to closely fit the curvature of lateral gunwales 13. Lateral gunwale mounting plates 20 and 21 have cut-away areas 22 and 23, most advantageously seen in FIG. 3, to allow the mounting means to fit close to attachment means 15 and 16 of raft 10.

Figure 5:
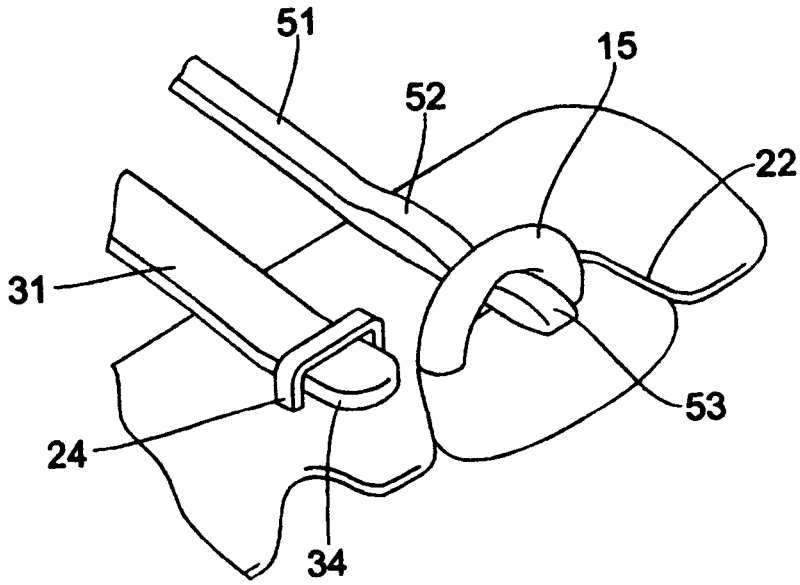
FIG. 5 is a detail drawing illustrating the interaction of the forward seat support frame member with the lateral support members of a preferred embodiment of the seating and rowing attachment of the present invention.
Figure 6:
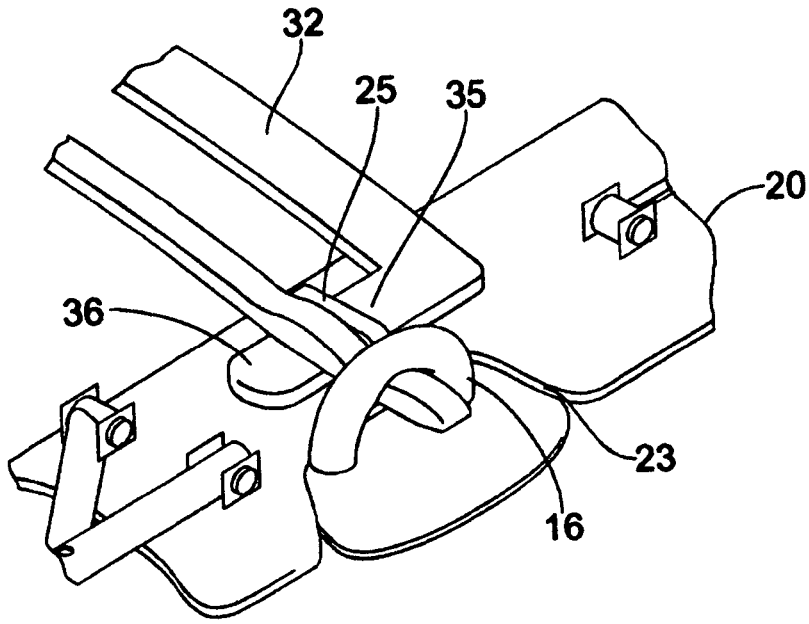
FIG. 6 is a detail drawing illustrating the interaction of the rear seat support frame member with the lateral support members of a preferred embodiment of the seating and rowing attachment of the present invention.

In a preferred embodiment of the present invention, seat support means comprise seat support frame 30 which comprises a unitary structure comprising forward 31 and rear 32 cross-members connected by longitudinal members 33. Forward 31 and rear 32 cross-members of seat support means 30 are detachably attached to lateral gunwale mounting plates 20 and 21 by any of the detachable attachment means known to the art, such as bolts with wing-nuts or hook-and-loop fastening means such as Velcro®. In the most preferred embodiment, the attachment means comprise staple-like loops 24 and 25, most advantageously seen in FIGS. 3, 5 and 6, which are molded as integral parts of lateral gunwale mounting plates 20 and 21, and into which the ends 34 and 36 of cross-members 31 and 32, respectively, are inserted. Further in this most preferred embodiment, the lateral ends of rear cross-member 32 are formed into right-angle rearwardly-directed segments 35.

Seat 60 may be removably attached to seat support frame 30 by any fastening means known to the art, such as screws, bolts and nuts, clamps, etc. In the most preferred embodiment, the seat may be Model 5440 manufactured by Action Products Corp. of Odessa, Mo., or any similar swivelable seat. The seat will preferably have a seat back which folds down for compact storage. In this most preferred embodiment, the seat is removably attached to seat-mounting holes 39 by means of bolts with wing-nuts, to permit assembly of the attachment of the present invention without tools.

Figure 4:
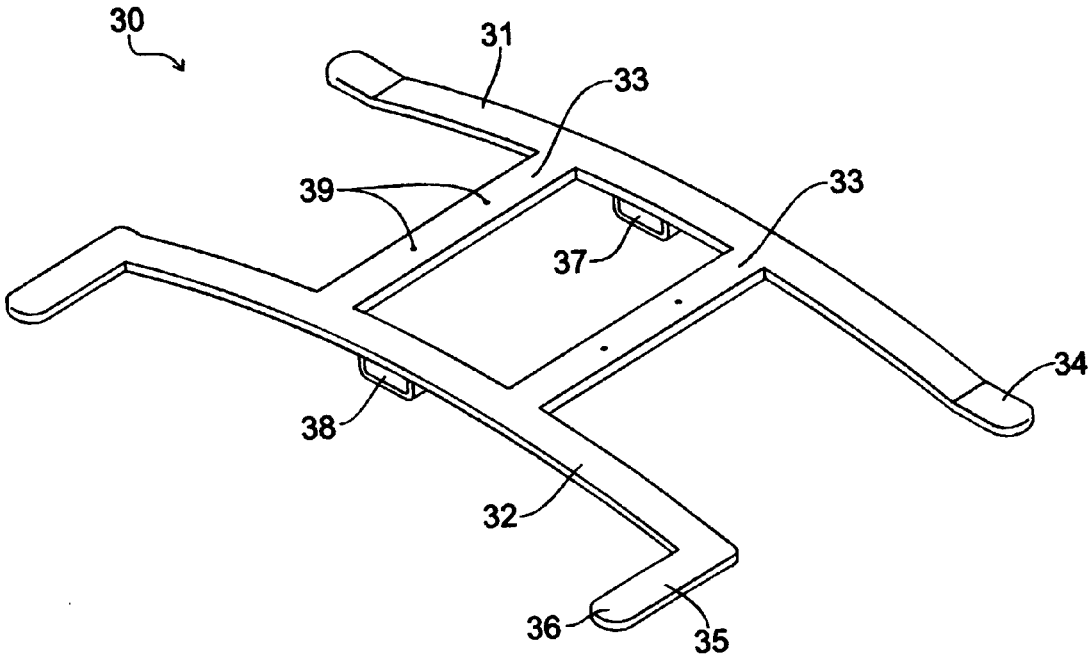
FIG. 4 is an enlarged drawing of the seat support frame of a preferred embodiment of the seating and rowing attachment of the present invention.

Locking means to hold seat support means in place may comprise cables securing seat support means to inflatable raft attachment means such as rings 15 and 16, clamps equipped with thumb-screws to fasten the ends 34 and 36 to loops 24 and 25, or any other locking means known to the art. In a preferred embodiment of the present invention, locking means comprise central support bar 40 and forward and rear locking bars 51. Central support bar 40 is detachably attached to seat support frame 30 by any of the detachable attachment means known to the art, such as bolts with wing-nuts or hook-and-loop fastening means such as Velcro®. In the most preferred embodiment, the attachment means comprise staple-like loops 37 and 38, most advantageously seen in FIGS. 3 and 4, molded as integral parts of cross-members 31 and 32, respectively.

Figure 7:
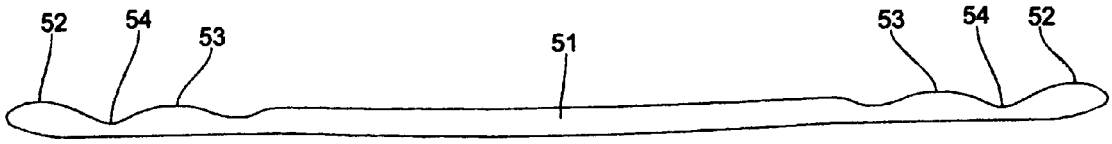
FIG. 7 is a side-view drawing of the locking bar of a preferred embodiment of the seating and rowing attachment of the present invention.

In a preferred embodiment, locking bars 51 bear upon central support bar 40 and are bent downward at the ends to allow engagement in inflatable raft attachment means 15 and 16, as shown in FIGS. 1, 2, 5 and 6. As shown in FIG. 7, each of the lateral ends of locking bars 51 have two thickened sections 52 and 53, forming detent 54. This detent will cooperate with the elastic resistance to bending of locking bar 51 to insure that locking bars 51 remain engaged in raft attachment means 15 and 16. The rearward end 41 of central support bar 40 is also increased in thickness, to prevent it from sliding forward and disengaging from rear locking bar 51.

This preferred embodiment of the present invention is advantageous in that the weight of seat, seat support means, and user are borne by the gunwale mounting means, and widely distributed to the gunwales of the inflatable raft, rather than being borne solely by the attachment means of the raft. An additional advantage of the preferred embodiment is that the locking bars will anchor the attachment firmly to the inflatable raft under conditions of rough water or a strenuous effort to land a vigorously fighting fish, or in the event the raft is inadvertently capsized.

In a preferred embodiment of the attachment of the present invention, central support bar 40 is extended forward to terminate a short distance forward of the forward end 11 of inflatable raft 10. In this embodiment, central support bar 40 comprises forward gunwale support plate 42 which rests on the forward gunwale 14 and is formed into a curved shape which conforms closely to the curvature of gunwale 14. In this preferred embodiment, central support bar 40 further comprises open clam cleat 43 and bull's-eye fairlead 44, both of which are well known in the art and are readily available articles of commerce. These latter devices enable the user of an inflatable raft equipped with the attachment of the present invention to deploy an anchor to keep the craft stationary against wind or current, or a drag to keep the craft oriented with forward end upstream or upwind while the craft slowly drifts with the current or wind.

In the most preferred embodiment of the attachment of the present invention, the forward extension 45 of central support bar 40 is elevated above forward end 11 of inflatable raft 10 and extended beyond the forward end sufficiently that an anchor or drag can be completely withdrawn from the water when the anchor or drag is not in use, and suspended above the water by the central support bar.

Open clam cleat 43 allows easy adjustment of the anchor- or drag-line length, and also allows the user to quickly jettison the anchor or drag in an emergency.

Figure 8:
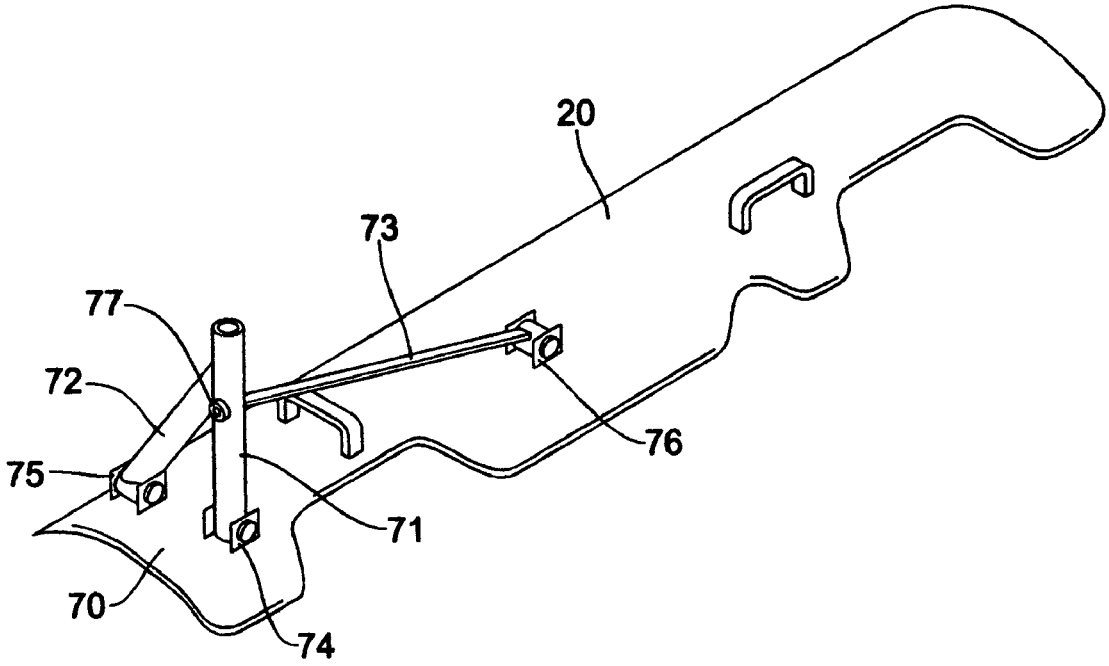
FIG. 8 is a detail drawing of the oarlock support of a preferred embodiment of the seating and rowing attachment of the present invention.

Oarlock support means of the attachment of the present invention may be any type of support which positions oarlocks so as to permit convenient and effective rowing, and which allow the oarlock support means to be removed, folded or collapsed when the attachment is dismounted from the inflatable raft, in order to reduce the size of the dismounted and disassembled attachment. As shown in FIG. 8, a preferred embodiment of oarlock support means comprises vertical oarlock support 71, lateral oarlock support brace 72 and longitudinal oarlock support brace 73, all of which are attached at their lower ends to lateral gunwale mounting plates 20 and 21 by means of clevis-and-pin hinges 74, 75 and 76, respectively. Vertical oarlock support 71 may be fabricated of tubing of diameter selected to form a loose sliding fit for the oarlocks, or incorporate a cylindrical recess of diameter selected to form a loose sliding fit for the oarlocks. Oarlock support means may be fabricated from any sufficiently strong material, such as steel or aluminum.

In the most preferred embodiment, vertical oarlock support 71 and lateral oarlock support brace 72 are fabricated of steel tubing, and are welded together to form a single unit. Hinges 74 and 75 permit this assembly of vertical oarlock support 71 and lateral oarlock support brace 72 to fold flat when the attachment of the present invention is disassembled. In this most preferred embodiment, longitudinal support brace 72 is flattened and bent vertical at its upper end, and detachably attached to vertical oarlock support 71 by means of a bolt and wing-nut 77.

Oarlocks may be any of the commercially available oarlocks, such as the Seadog Round Rowlock, Catalog ID 23832 or the Attwood Clamp-on Oarlock, Catalog ID 23830, both obtainable from The Binnacle, Halifax, Nova Scotia, or the Perko #298113 Round Oarlocks, obtainable from Performance Yacht Systems, Annapolis, Md.

The operation of the most preferred embodiment of the present invention is as follows: Inflatable raft 10 is inflated fully. Lateral gunwale mounting plates 20 and 21 are placed on the lateral gunwales 13 and adjusted to fit closely to attachment means 15 and 16. Seat support frame 30 is then placed on gunwale mounting plates and adjusted so that ends 34 and 35 of forward 31 and rear 32 cross-members engage loops 24 and 25, respectively, on lateral gunwale mounting plates 20 and 21. Seat 60 may be fastened to seat support frame 30 either before or after seat support frame 30 is connected to lateral gunwale mounting plates 20 and 21.

Central support bar 40 is then slid into staple-like loops 37 and 38 and adjusted so that forward gunwale support plate 42 rests on the forward gunwale 14. Locking bars 51 are then placed over central support bar 40 and bent downward at the ends to engage inflatable raft attachment means 15 and 16, sliding the locking bars to-and-fro laterally if necessary to complete engagement.

The unit comprising vertical oarlock support 71 and lateral oarlock support brace 72 is then folded upward to a vertical position, and the upper end of longitudinal support brace 72 is attached this unit with bolt and wing-nut 77. Oarlocks are then inserted into vertical oarlock support 71, suitable oars are deployed in the oarlocks, and an anchor- or drag-line is threaded through bulls-eye fairlead 44 and engaged in open clam cleat 43.

The watercraft comprising the inflatable raft equipped with the seating and rowing attachment of the present invention may then be launched into a body of water and placed in use.

Disassembly for stowing reverses the above sequence. The disassembled attachment comprises 7 parts: seat 60, two locking bars 51, central support bar 40, seat support frame 30, and two lateral gunwale mounting plates 20 and 21. The disassembled attachment and the deflated inflatable raft can easily be accommodated in the trunk of most automobiles.

While the foregoing describes preferred modes of practicing the invention, other embodiments are possible.

In one such alternate embodiment, seat support means such as seat support frame 30 could be attached directly to inflatable raft attachment means 15 and 16 by clamps or screw-operated assemblies.

In another alternate embodiment, seat support frame 30 could be attached to staple-like loops 24 and 25 by clamping means well-known in the art, or by affixing pins or screws to the portions of lateral ends 34 and 36 of cross-members 31 and 32 extending beyond the loops.

In another alternate embodiment, the lateral ends 34 of forward cross-member 31, and the ends 36 of the rearwardly-directed segments 35 of rear cross-member 32 may be increased in thickness, so as to provide a latching action when inserted into loops 24 and 25.

In still another alternate embodiment, the oarlock support means could be detachably attached to lateral gunwale mounting plates 20 and 21 by screw means or other detachable attachment means known to the art. A hinged attachment between longitudinal oarlock support brace 73 and vertical oarlock support 71 would allow the oarlock support means of this embodiment to be folded into a compact form after detachment from lateral gunwale mounting plates 20 and 21.

Other embodiments will be apparent to one skilled in the art, which will change various details of the present invention without limiting its scope. Furthermore, the foregoing description of various embodiments of the invention and the best mode for practicing the invention are provided for the purpose of illustration only and not for the purpose of limitation of the invention, which are defined by the claims attached hereto.

I claim:

1. An inflatable watercraft comprising:

left and right lateral inflatable tubular flotation structures, each connected to a forward inflatable tubular flotation structure, said flotation structures disposed at least on either side and on the forward end of a central floor section;

attachment means integrally connected to said lateral flotation structures;

a support structure detachably and lockably attachable to said attachment means, said supporting structure comprising:

gunwale mounting plates mounted on and supported by the lateral inflatable tubular flotation structures comprising the lateral gunwales of the inflatable watercraft;

a seat support frame spanning said gunwale mounting plates;

means for detachably and lockably attaching said seat support frame to said gunwale mounting plates;

a swivelable seat detachably attachable to said support structure; and oarlock supports attached to said support structure.

2. The inflatable watercraft of claim 1 in which the support structure further comprises a detachable longitudinal central support bar.

3. The inflatable watercraft of claim 2 in which the detachable longitudinal central support bar bears on the inflated tubular structure constituting the forward end of the inflatable watercraft.

4. The inflatable watercraft of claim 3 in which the central support bar extends forward of the forward edge of the inflatable watercraft and is equipped with means for guiding a rope line attachable at one end to an anchor or drag, and means for fastening the other end of said rope line at a desired position or extension of said rope line.

5. The inflatable watercraft of claim 4 in which the forward extension of the central support bar is disposed upwardly and forwardly of the forward end of the inflatable watercraft sufficiently that the anchor or drag can be raised above the level of the water in which said inflatable watercraft is floating by retracting said rope line attached to said anchor or drag.

6. The inflatable watercraft of claim 1 in which said gunwale mounting plates are laterally and downwardly curved so as to fit closely to the lateral inflatable tube structures comprising the lateral gunwales of the inflatable watercraft.

7. The inflatable watercraft of claim 6 in which means for detachably and lockably attaching said seat support frame to said gunwale mounting plates comprise sockets attached to said gunwale mounting plates for receiving the lateral ends of the seat support frame.

8. The inflatable watercraft of claim 6 in which the seat support frame comprises forward and rear transverse cross-members spanning the gunwale mounting plates, said forward and rear transverse cross-members being connected together by longitudinal members.

9. The inflatable watercraft of claim 2 in which the support structure comprises:

gunwale mounting plates laterally and downwardly curved so as to fit closely to the lateral inflatable tube structures comprising the lateral gunwales of the inflatable watercraft;

means for locking said gunwale mounting plates to the lateral gunwales of the inflatable watercraft;

a seat support frame spanning said gunwale mounting plates;

means for detachably and lockably attaching said swivelable seat support frame to said gunwale mounting plates; and means for detachably attaching a swivelable seat to said seat support frame; and oarlock supports attached to said support structure.

10. The inflatable watercraft of claim 9 in which means for detachably and lockably attaching said seat support frame to said gunwale mounting plates comprise sockets attached to said gunwale mounting plates for receiving the lateral ends of the seat support frame.

11. The inflatable watercraft of claim 9 in which the seat support frame comprises forward and rear transverse cross-members spanning the gunwale mounting plates, said forward and rear transverse cross-members being connected together by longitudinal members upon which a swivelable seat is detachably attachable.

12. The inflatable watercraft of claim 9 in which the attachment means integrally connected to said lateral flotation structures of said inflatable watercraft comprise sockets, and in which the means for locking the gunwale mounting plates to the lateral gunwales of the inflatable watercraft comprise transverse locking bars bearing on the central support bar and elastically flexed downwardly and engaged in said sockets.

13. The inflatable watercraft of claim 12 in which the transverse locking bars comprise detents near the lateral ends to counteract any tendency of said locking bars to slip out of engagement in the attachment means integrally attached to the inflatable watercraft.

14. The inflatable watercraft of claim 12 in which the lateral ends of at least one of the transverse cross-members of the seat support frame are extended substantially perpendicularly to the axis of said cross member to form locking tabs, so that the lateral ends of at least one of the transverse locking bars bear on said locking tabs in addition to engagement in the attachment means integrally attached to the inflatable watercraft.

15. The inflatable watercraft of claim 10 in which means for lockably attaching forward and rear transverse cross-members of the seat support frame to the gunwale mounting plates comprise short terminal segments of increased thickness at the ends of said cross-members, to provide a latching action to counteract any tendency for said ends of said cross-members to slide out of the sockets on the gunwale support plates.

16. The inflatable watercraft of claim 1 in which the oarlock supports comprise vertical members attached at their lower ends to either side of the support frame with a receiver at each of their upper ends to receive an oarlock.

17. The inflatable watercraft of claim 16 in which the oarlock supports are detachably attached to the support frame.

18. The inflatable watercraft of claim 16 in which the oarlock supports comprise pivot means at their lower ends to permit said oarlock supports to be folded down against the support frame when not in use, and detachable braces to support said oarlock supports in the vertical position when in use.

19. The inflatable watercraft of claim 2 in which the oarlock supports comprise vertical members attached at their lower ends to either side of the support frame and with a receiver at each of their upper ends to receive an oarlock.

20. The inflatable watercraft of claim 19 in which the oarlock supports are detachably attached to the support frame.

21. The inflatable watercraft of claim 19 in which the oarlock supports comprise pivot means at their lower ends to permit said oarlock supports to be folded down against the support frame when not in use, and detachable braces to support said oarlock supports in the vertical position when in use.

* * * * *